United States Patent [19]

Wolf

[11] Patent Number: 4,620,899

[45] Date of Patent: Nov. 4, 1986

[54] BREAST BOX NOZZLE FOR A PAPER MACHINE

[75] Inventor: Karl Wolf, Heidenheim, Fed. Rep. of Germany

[73] Assignee: J. M. Voith GmbH, Heidenheim, Fed. Rep. of Germany

[21] Appl. No.: 751,217

[22] Filed: Jul. 3, 1985

[30] Foreign Application Priority Data

Jul. 11, 1984 [DE] Fed. Rep. of Germany ..... 3425433

[51] Int. Cl.[4] ..... D21F 1/06; D21F 1/02

[52] U.S. Cl. ..... 162/344; 162/336; 162/347

[58] Field of Search ..... 162/344, 345, 346, 347, 162/336; 425/381, 466

[56] References Cited

U.S. PATENT DOCUMENTS

| | | | |
|---|---|---|---|
| 3,010,510 | 11/1961 | Cirrito | 162/347 |
| 3,645,843 | 2/1972 | Schmaeng | 162/347 |
| 4,326,916 | 4/1982 | Flaig | 162/344 |
| 4,517,056 | 5/1985 | Roerig et al. | 162/344 |

*Primary Examiner*—S. Leon Bashore
*Assistant Examiner*—K. M. Hastings
*Attorney, Agent, or Firm*—Lon H. Romanski

[57] ABSTRACT

A breast box nozzle for a paper making machine or the like is shown as having an adjustably positionable shutter member which can be moved generally further and lesser into the path of flow of a stream of pulp stock as to thereby determine the thickness of the discharge stream of pulp stock; a support arrangement applies a pressure to the shutter member as against a downstream side thereof in order to counter the forces generated by the stream of pulp stock upstream of the shutter member and applied as against the upstream side thereof tending to undesirably deform the shutter member; the support arrangement has an elastomeric member, which can be internally pressurized, generally interposed between a relatively fixed support member and a downstream side of the shutter member; and an elongated slide member is generally interposed between the elastomeric member and the downstream side of the shutter member.

18 Claims, 1 Drawing Figure

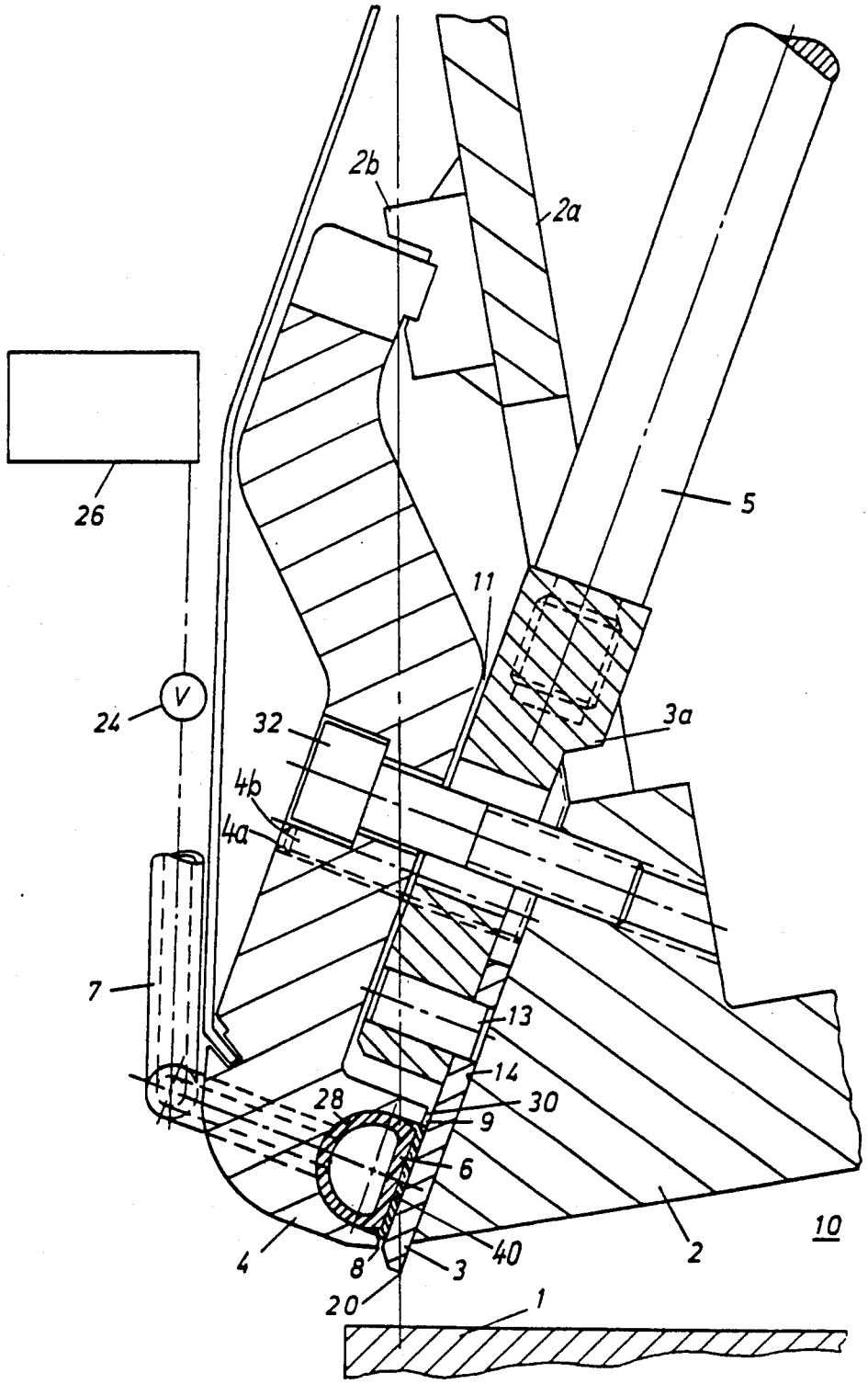
2b
2a
26
5
11
24
V
32
3a
4b
4a
7
13
14
28
30
9
6
10
4
8
3
40
2
20
1

BREAST BOX NOZZLE FOR A PAPER MACHINE

FIELD OF THE INVENTION

This invention relates generally to paper-making machines and more particularly to the nozzle means, of a paper-making apparatus, through which flows a stream of pulp stock.

BACKGROUND OF THE INVENTION

Heretofore it has been known to provide nozzle means, for the breast box of a paper-making machine, wherein the nozzle means comprises an opening or gap, through which pulp stock is flowed, and wherein such opening or gap is comprised of a lower disposed lip or lip surface and an upper disposed lip or lip surface. Further, in such prior art structures a shutter means or member, operatively carried as at a downstream position of such upper lip, can be moved, generally, upwardly and downwardly as to thereby selectively determine the effective height of such opening or gap. Such reciprocal movement of the shutter is usually accomplished as by a plurality of threaded spindles which operatively engage the shutter and which are operated as by, for example, handwheels or the like.

The thusly selected width of the gap or opening of the breast box nozzle therefore determines the thickness of the stream of pulp stock emerging from the nozzle.

In such arrangements the shutter projects downwardly some amount into the stream of pulp stock and consequently experiences a considerable pressure thereagainst, at the upstream side of the shutter, applied by such flowing stream of pulp stock. Such pressure causes some degree of deflection in the shutter which, in turn, results in uncontrolled variations in the effective width of the nozzle gap causing defects in the resulting paper web.

The prior art has been aware of the problem of such undesired shutter deflection, and the defects in the resulting paper web, and has attempted to solve such problem as by, for example: significantly increasing the thickness of the shutter, which is usually constructed as in the form of a steel straight-edge member; dividing the shutter member into separate sections which are, generally, functionally aligned as to span the entire longitudinal length of the nozzle gap or opening; and providing for a more sensitive adjustment of the threaded adjustment spindles as to thereby, hopefully, offset the effects of the upstream created pressure on the shutter means and eliminate the resulting surface-weight fluctuations occurring in the subsequent paper web, paper, strips and the like. None of such prior art attempts has proven to be successful and such defects and surface-weight fluctuations of the paper web and paper product continued.

In the embodiments of breast box nozzles heretofore employed, a support is provided as to lie directly against, what may be termed, the downstream side of the straight-edge type of shutter. Such support was intended to hold the shutter in such a way as to prevent deformation of the shutter due to the upstream pressure created by the flow of pulp stock. However, despite efforts, the prior art has been unable to manufacture a shutter so dimensionally accurate as to assure that the said support would always rest flush, throughout its length, against the shutter member. The manufacturing tolerances, in order to attain the required flatness, surface parallelism, etc., are extremely critical (and for all practical purposes unattainable) since the slightest undesired curvature or warping of the shutter edge exerts a damaging influence on the quality of the stream of pulp stock and the resulting paper web. Consequently, because of the unattainable dimensional accuracy, the said support, instead of lying flush (along its entire functional length) against the shutter actually engages the shutter only at what amounts to spaced points. Such, of course, only further encouraged the undesired bowing or deflection of the shutter. Even with manufacture to close tolerances, due to the considerable temperature fluctuations arising in the area of the shutter, internal and applied material stresses are released which, again, result in the non-flush contact as between the shutter and said support.

Such problems of the prior art have been overcome by the structure disclosed and claimed in U.S. Pat. No. 4,326,916 dated Apr. 27, 1982. Briefly, said Letters Patent discloses a breast box nozzle assembly comprising a support member and elastomeric means operatively interposed between the support member and a downstream side of the associated shutter whereby the elastomeric means is effective to react against the support member and apply a reacting force as a counter pressure to the downstream side of the shutter to thereby hold the shutter against its cooperating mounting surface while still permitting the shutter to be adjustably moved in either of two directions of travel.

A problem has been discovered with the structure of said Letters Patent. That is, after prolonged use there is the possibility that the elastomeric means may become damaged. More particularly, in the preferred embodiment of the structure of said Letter Patent the elastomeric means comprises a hose-like or tube-like means which is internally pressurized as to thereby act against the shutter. Further, a structural clearance or gap exists as between the shutter and a juxtaposed end of the associated support member against which the elastomeric means reacts. In the prolonged use of such a structure there is a possibility that the elastomeric means will become damaged as at an area where it is urged toward or pressed into such gap between the shutter and said associated support member. Such a possibility of damage increases especially when thick paper grades are being produced and the shutter is moved as to provide a correspondingly wide opening thereby requiring a considerably greater movement of the shutter, relative to elastomeric means, and a greater tendency to frictionally force the elastomeric means into said gap.

The invention as herein disclosed and claimed is primarily directed to an improvement whereby the possibility of such damage occurring to said elastomeric means is eliminated or at least greatly minimized even though the shutter may have to be adjustably moved a relatively long distance.

SUMMARY OF THE INVENTION

According to the invention, a breast box nozzle comprises a nozzle opening extending generally laterally, the nozzle opening being at least in part comprised of an upper disposed lip portion, a shutter operatively carried as to extend across the lateral extent of said opening, said shutter being adjustably positionable relative to said upper lip portion as to thereby selectively adjust the effective height of said opening and thereby select the thickness of the stream of pulp stock flowing through said opening, support means effective to apply a force against said shutter along the downstream side of said shutter counter to the force created by the pressure of the flow of the paper stock acting against the upstream side of said shutter, said support means comprising force reaction means and elastomeric means, said elastomeric means being generally interposed between said force reaction means and said shutter whereby said elastomeric means is effective to apply to said shutter at least a portion of the force along the downstream side of said shutter, and slide means interposed generally between said elastomeric means and said shutter.

An object of the invention is to provide a breast box nozzle of the general type described, employing elastomeric means for holding the shutter against undesired deflection, with means for preventing possible damage to said elastomeric means as may otherwise occur during the adjustable positioning of the shutter.

Other general and specific objects, advantages and aspects of the invention will become apparent when reference is made to the following detailed description considered in conjunction with the accompanying drawing.

BRIEF DESCRIPTION OF THE DRAWING

The single drawing, wherein for purposes of clarity certain details and/or elements may be omitted, illustrates in general vertical cross-section, a breast box nozzle with a shutter employing teachings of the invention.

DETAILED DESCRIPTION OF THE PREFERRED EMBODIMENT

Referring now in greater detail to the drawing, as is generally well known, a source of pulp stock supplies a generally fluid stream of such pulp stock to the nozzle means of the drawing wherein the said nozzle is illustrated as comprising upper disposed lip means 2 and lower disposed lip means 1 which cooperate to define a passageway 10 therebetween (in conjunction with opposite end wall means not shown but well known) for the flow therethrough of said stream of pulp stock. In the embodiment shown, the passageway between lip means 1 and 2 converges as it approaches what could be considered to be the downstream end of upper lip or passage wall 2. (Such downstream end may be considered as the intersection of the upstream side or surface of shutter 3 and a mounting surface 14 to be described.)

Rigidly connected with the upper lip 2 is a front wall 2*a* which extends upwardly from the upper lip 2. A plurality of abutment or bearing seats 2*b* are arranged on and carried by the front wall 2*a*.

A shutter 3 is placed as against a surface 14, formed as on upper lip structure 2, and is operatively connected to a beam 3*a* and to related adjustment means which may take the form of threaded spindles one of which is typically illustrated at 5. The purpose of such adjustment means, as is well known in the art, is to enable the selective adjustable positioning of the shutter 3 in generally upward and downward directions as viewed in the drawing. In so doing, of course, shutter 3 will move relative to surface 14 and, depending upon the direction of travel, will bring the horizontally extending edge 20 of shutter 3 closer to or further away from the surface of lower lip structure 1 thereby selectively establishing the height, or width, of the discharge opening of nozzle passageway 10 which would otherwise be determined as by the distance between said downstream end of upper lip structure 2 and lower lip structure 1.

The shutter 3 is, in turn, held in its selectively adjusted position against surface means 14 as by support means which, in the preferred embodiment, is depicted as comprising a support member 4, suitably secured as to the upper lip structure 2 as by means of the upper disposed latching or support members 2*b*, and elastomeric means 6 situated generally between the support member 4 and the shutter 3. In the preferred embodiment, the elastomeric means 6 would extend, generally horizontally, across the functional length of the shutter 3 as to be effective for applying a force, or pressure, thereto counter to that created by the stream of pulp stock flowing in nozzle passageway 10.

Further, in the preferred embodiment of the invention, the elastomeric means 6 comprises an elastomeric hose-like or tubular member which, in turn, is filled with a fluid. Still further, in the preferred embodiment of the invention, the elastomeric hose-like or tubular member 6 is in fluid communication with associated supply conduit means 7, which may comprise pressure regulating valve means 24, leading to a suitable source of fluid pressure 26.

As depicted in the drawing, the elastomeric member 6 may be carried as within a groove-like recess 28 which may be formed in an end surface or portion of support member 4 with such recess being of a relative dimension as to enable the extension of the side of the elastomeric means 6 beyond the end surface 30 of support member 4.

Shutter 3 and beam 3*a* extend, preferably horizontally, across the length of the discharge opening of nozzle passageway 10. Shutter 3 is connected to beam 3*a* by screws (not shown) and by pins, one of which is illustrated at 13. Support member 4 is connected to upper lip structure 2 by support screws one of which is illustrated at 32. In generally the central or mid region of support member 4 a plurality of threaded bores, one of which is shown at 4*a*, are provided into which respective cooperating spacer screws, one of which is shown at 4*b*, are threadably inserted. Said spacer screws extend through cooperating clearances in said beam means 3*a* as to operatively engage surface 14 of upper lip 2. By selective adjustment of the spacer screws 4*b* the magnitude of the spaces or gaps 8 and 9, between the end face 30 of support member and shutter 3, as well as the magnitude of a space or gap 11, between support member 4 and beam means 3*a*, is established. Thus, such an arrangement assures that all counter force is transmitted through elastomeric means 6 and that inspite of said transmission of force the shutter may be adjusted during operation of the breast box nozzle.

As also shown in the drawing, a slide means or bearing means 40 is interposed generally between the elastomeric means 6 and shutter means 3. In the preferred embodiment the slide means 40, shown in transverse cross-section, is elongated and extends across the entire width of the nozzle as to extend at least the length of the shutter means 3. Further, in the preferred embodiment, the bearing means 40 is of a generally C-shaped or U-shaped cross-sectional configuration having what may be referred to as oppositely disposed leg or wall portions each of which are preferably tapered as to terminate in generally pointed longitudinally extending edges or ends.

Although the slide means 40 may be formed, for example, of a thin relatively flexible soft bronze material, it has also been discovered that it is especially advantageous to use plastic materials, for example, such as "Robalon-Z", which have an especially low coefficient of adhesion and are especially flexible. Such characteristics enable the slide or bearing means 40 to apply a force as uniformly and as effectively as applied by the elastomeric means 6 itself thereby assuring that the shutter 3 will be as snugly held as has previously been the case with the hose or elastomeric means 6, alone.

As was stated, in the preferred embodiment the opposed longitudinally extending side walls or legs are tapered and each is of a length (or depth) sufficient as to have at least a substantial portion thereof received in the recess 28 so that upon fluid pressurization of the hose means or elastomeric means 6 the said side walls or legs are forced generally outwardly, by the pressurized hose means 6, against the juxtaposed side surfaces of the recess means 28 thereby creating an effective barrier to any tendency of having the hose means forced toward or into either of gaps 8 or 9.

As should now be apparent, the slide means 40: (a) serves to effectively contain the elastomeric means 6 from being damaged by any tendency to force the hose means 6 into either of gaps 8 or 9; (b) serves to save wear on the hose means 6 as may occur during normal adjustment and positioning of the shutter 3; (c) transmits the holding force, provided by hose means 6, in a manner whereby the shutter 3 is as effectively held as by the hose means 6, alone; and (d) permits the shutter 3 to be selectively positioned without any attendant adverse effects. Further, it has been discovered that the force transmitted through slide means 40 and against the shutter 3 to hold the shutter 3 firmly against the upper lip 2 remains intact during conditions of temperature fluctuations as well as in those situations where the shutter 3 is intentionally deformed, for example, as by adjusting only one or only some of the threaded spindles 5.

OPERATION OF THE INVENTION

Support member 4 may cause an elastomeric deflection of elastomeric means 6 against shutter 3 thereby applying thereto a counter pressure and force generally oppositely directed to that pressure or force existing against the shutter 3 and created by the stream of pulp stock.

That is, as should now be apparent, as the flow of pulp stock is forced through nozzle passageway 10 (from right to left as viewed in the drawing) the stream of pulp stock flows against the depending portion of the upstream side of the shutter means 3 and in so doing applies a pressure thereagainst the resulting force of which tends to bow or move the shutter means 3 in a direction generally away from surface 14 and thereby result in the product defects hereinbefore described. Providing intermediate elastomeric means 6, for the application of a counter pressure (and resulting counter force) uniformly across the functional length of the shutter 3, prevents the occurrence of such undesired movement by the shutter means 3 throughout its entire functional length. The elastomeric means 6, of course, functions to transmit the entire force exerted by the support member 4 to the shutter means 3 with such transmission of force occurring in a manner as to apply it to the shutter means 3 uniformly along its functional length without adverse influence because of such factors as uneven surface conditions on the shutter means 3 against which the elastomeric means 6 is acting.

As previously indicated, the elastomeric means 6 may be of a hose-like or tubular configuration and, further, is in fluid communication with a source of fluid pressure. Accordingly, as generally depicted in the drawing, with the support member 4 positioned as illustrated, fluid under superatmospheric pressure can be directed to the interior of the elastomeric tubular means 6 and in so doing even increasing the pressure and resulting counter force against the shutter means 3.

It should be made clear that as the elastomeric tubular means 6 is pressurized, with a suitable fluid from source 26, the tubular means 6 tends to expand and in so doing effectively wedges the said opposed side walls or legs of bearing or slide means 40 against the juxtaposed inner surface of recess 28 while at the same time urging the main body portion of slide means 40, such main body portion being that generally sandwiched between tubular means 6 and shutter means 3, against the shutter means 3. As a consequence a uniformity of resisting force is applied throughout the functional length of shutter means 3 keeping it against surface 14 of upper lip 2. Further, even though the shutter 3 may be adjusted upwardly or downwardly a relatively long distance along surface 14, such movement of shutter 3 will not result in tubular means 6 tending to be pinched into either gaps 8 or 9 because slide means 40, and in particular the said opposed side walls or legs thereof being contained as they are, preclude any movement of the tubular means 6 into such gaps or spaces 8 and 9.

Although only a preferred embodiment of the invention has been disclosed and described, it is apparent that other embodiments and modifications of the invention are possible within the scope of the appended claims.

What is claimed is:

1. A breast box nozzle assembly, comprising structure defining nozzle passage means terminating in a nozzle passage discharge orifice for the flow therethrough of a fluid stream of pulp stock, said nozzle passage means comprising at least upper disposed lip structure means, a mounting surface carried by said lip structure means, a shutter situated operatively against said mounting surface carried by said lip structure means and adjustably movable along said mounting surface in at least two directions for adjustably determining the effective opening and effective configuration of said discharge orifice, when moved in a first of said two directions along said mounting surface said shutter extending generally transversely relatively further into said stream of fluid pulp, when moved in a second of said two directions opposite to said first direction and along said mounting surface said shutter extending generally transversely relatively less into said stream of fluid pulp, adjustment means for adjustably moving said shutter in said first and second directions, support means for operatively applying a counter pressure to a downstream side of said shutter which counter pressure opposes the fluid pressure applied to an upstream side of said shutter by said stream of fluid pulp, said support means comprising a support member, elastomeric means operatively interposed between said support member and said downstream side of said shutter in a manner whereby a space exists between said support member and said downstream side of said shutter, said elastomeric means being effective to react against said support member and apply a reacting force as said counter pressure to said downstream side of said shutter, and slide means interposed between said elastomeric means and said downstream side of said shutter, said slide means being effective to transmit said reacting force from said elastomeric means and structured to prevent said elastomeric means from entering said space during periods when said shutter is adjustably moved relative to said support member.

2. A breast box nozzle assembly according to claim 1 wherein said slide means is of an elongated configuration and extends for the entire functional length of said shutter.

3. A breast box nozzle assembly according to claim 1 wherein said slide means is comprised of soft bronze material.

4. A breast box nozzle assembly according to claim 1 wherein said slide means is comprised of plastic material.

5. A breast box nozzle assembly according to claim 2 wherein said slide means is comprised of soft bronze material.

6. A breast box nozzle assembly according to claim 2 wherein said slide means is comprised of plastic material.

7. A breast box nozzle assembly, comprising structure defining nozzle passage means terminating in a nozzle passage discharge orifice for the flow therethrough of a fluid stream of pulp stock, said nozzle passage means comprising at least upper disposed lip structure means, a mounting surface carried by said lip structure means, a shutter situated operatively against said mounting surface carried by said lip structure means and adjustably movable along said mounting surface in at least two directions for adjustably determining the effective opening and effective configuration of said discharge orifice, when moved in a first of said two directions along said mounting surface said shutter extending generally transversely relatively further into said stream of fluid pulp, when moved in a second of said two directions opposite to said first direction and along said mounting surface said shutter extending generally transversely relatively less into said stream of fluid pulp, adjustment means for adjustably moving said shutter in said first and second directions, support means for operatively applying a counter pressure to a downstream side of said shutter which counter pressure opposes the fluid pressure applied to an upstream side of said shutter by said stream of fluid pulp, said support means comprising a support member, elastomeric means operatively interposed between said support member and said downstream side of said shutter in a manner whereby a space exists between said support member and said downstream side of said shutter, said elastomeric means being effective to react against said support member and apply a reacting force as said counter pressure to said downstream side of said shutter, and slide means interposed between said elastomeric means and said downstream side of said shutter, said slide means being effective to transmit said reacting force from said elastomeric means and structured to prevent said elastomeric means from entering said space during periods when said shutter is adjustably moved relative to said support member, wherein said slide means is of a generally U-shaped cross-sectional configuration having oppositely disposed side walls, and wherein said side walls function as barrier means between said elastomeric means and said space.

8. A breast box nozzle assembly according to claim 7 wherein said slide means is of an elongated configuration and extends for the entire functional length of said shutter.

9. A breast box nozzle assembly according to claim 8 wherein said slide means is comprised of soft bronze material.

10. A breast box nozzle assembly according to claim 8 wherein said slide means is comprised of plastic material.

11. A breast box nozzle assembly according to claim 7 wherein said slide means is comprised of soft bronze material.

12. A breast box nozzle assembly according to claim 7 wherein said slide means is comprised of plastic material.

13. A breast box nozzle assembly, comprising structure defining nozzle passage means terminating in a nozzle passage discharge orifice for the flow therethrough of a fluid stream of pulp stock, said nozzle passage means comprising at least upper disposed lip structure means, a mounting surface carried by said lip structure means, a shutter situated operatively against said mounting surface carried by said lip structure means and adjustably movable along said mounting surface in at least two directions for adjustably determining the effective opening and effective configuration of said discharge orifice, when moved in a first of said two directions along said mounting surface said shutter extending generally transversely relatively further into said stream of fluid pulp, when moved in a second of said two directions opposite to said first direction and along said mounting surface said shutter extending generally transversely relatively less into said stream of fluid pulp, adjustment means for adjustably moving said shutter in said first and second directions, support means for operatively applying a counter pressure to a downstream side of said shutter which counter pressure opposes the fluid pressure applied to an upstream side of said shutter by said stream of fluid pulp, said support means comprising a support member, elastomeric means operatively interposed between said support member and said downstream side of said shutter in a manner whereby a space exists between said support member and said downstream side of said shutter, said elastomeric means being effective to react against said support member and applying a reacting force as said counter pressure to said downstream side of said shutter, slide means interposed between said elastomeric means and said downstream side of said shutter, said slide means being effective to transmit said reacting force from said elastomeric means and structured to prevent said elastomeric means from entering said space during periods when said shutter is adjustably moved relative to said support member, and recess means formed in said support member, wherein said recess means comprises recess surface means, wherein said elastomeric means is at least partly received within said recess means as to be at least partly confined by said recess surface means, wherein said slide means comprises a main body portion and oppositely disposed first and second wall portions carried by said main body portion, wherein said main body portion is interposed between said elastomeric means and said shutter, and wherein said first and second wall portions are at least in part interposed between said elastomeric means and said recess surface means.

14. A breast box nozzle assembly according to claim 13 wherein said slide means is of an elongated configuration and extends for the entire functional length of said shutter.

15. A breast box nozzle assembly according to claim 14 wherein said slide means is comprised of soft bronze material.

16. A breast box nozzle assembly according to claim 14 wherein said slide means is comprised of plastic material.

17. A breast box nozzle assembly according to claim 13 wherein said slide means is comprised of soft bronze material.

18. A breast box nozzle assembly according to claim 13 wherein said slide means is comprised of plastic material.

* * * * *